US005584745A

United States Patent [19]

Nishioka et al.

[11] Patent Number: 5,584,745

[45] Date of Patent: Dec. 17, 1996

[54] METHOD OF MACHINING SILICON NITRIDE CERAMICS AND SILICON NITRIDE CERAMICS PRODUCTS

[75] Inventors: Takao Nishioka; Kenji Matsunuma; Akira Yamakawa, all of Itami, Japan

[73] Assignee: Sumitomo Electric Industries, Ltd., Osaka, Japan

[21] Appl. No.: 162,302

[22] Filed: Dec. 6, 1993

Related U.S. Application Data

[62] Division of Ser. No. 921,255, Jul. 29, 1992, Pat. No. 5,297,365.

[30] Foreign Application Priority Data

May 1, 1992 [JP] Japan ..... 4-112649

[51] Int. Cl.[6] ..... B24B 1/00

[52] U.S. Cl. ..... 451/28; 451/41

[58] Field of Search ..... 451/28, 41, 53, 451/57, 283, 285, 287; 51/307, 308, 309

[56] References Cited

U.S. PATENT DOCUMENTS

| | | | |
|---|---|---|---|
| 4,663,890 | 5/1987 | Brandt | 451/41 |
| 4,839,996 | 6/1989 | Sekiya | 451/182 |

FOREIGN PATENT DOCUMENTS

| | | | |
|---|---|---|---|
| 1194318 | 10/1985 | Canada | 451/28 |
| 63-156070 | 6/1988 | Japan . | |
| 4-115859 | 4/1992 | Japan . | |
| 986427 | 3/1965 | United Kingdom . | |
| 2025283 | 1/1990 | United Kingdom . | |

OTHER PUBLICATIONS

Yoshikawa (FC report, vol. 8, No. 5, pp. 148–155, Jan. 1990), Japan.

Yogyo Kyokai Shi, "Room Temperature Strength of β–Sialon Fabricated . . . ", vol. 94, first issue, pp. 189–192, Jan. 1986 (Kishi et al.), Japan.

Yogyo Kyokai Shi, "Effect of Heat Treatment on Strength of β–Sialon", vol. 95, sixth issue, pp. 630–637, Jan. 1987 (Kishi et al.), Japan.

Japanese Industrial Standard, "Definition and Designation of Surface Roughness", Jan. 1982, Japan.

Data Base Inspec, Institute of Electrical Engineers, Stevenage, GB, Inspec No. 3264725, Feb. 1988, Sakai S'mirror finish of silicon nitride ceramics by grinding process'*abstract* & Reports of the Government Industrial Research Institute, vol. 37, No. 1–2, Feb. 1988, Nagoya.

*Primary Examiner*—Robert A. Rose
*Attorney, Agent, or Firm*—Wenderoth, Lind & Ponack

[57] ABSTRACT

An industrially feasible method of grinding silicon nitride ceramics is disclosed and provides a sufficiently smooth surface. Namely, the surface has a maximum height-roughness Rmax of 0.1 microns or less and a ten-point mean roughness Rz of 0.05 microns. Further, with this method, surface damage can be repaired while grinding. The vertical cutting feed rate of a grinding wheel into a work piece should be within the range of 0.005–0.1 micron for each rotation of the working surface of the wheel and change linearly or stepwise. The cutting speed of the grinding wheel in a horizontal (rotational) direction should be within the range of 25 to 75 m/sec. With this arrangement, the contact pressure and grinding heat that is generated between the work piece and the hard abrasive grains during grinding are combined. In other words, mechanical and thermal actions are combined.

24 Claims, 2 Drawing Sheets

METHOD OF MACHINING SILICON NITRIDE CERAMICS AND SILICON NITRIDE CERAMICS PRODUCTS

This is a divisional application of Ser. No. 07/921,255, filed Jul. 29, 1992 now U.S. Pat. No. 5,297,365.

BACKGROUND OF THE INVENTION

The present invention relates to a method of machining silicon nitride ceramics and silicon nitride ceramic products, specifically sliding parts which are brought into frictional contact with metal parts at high speed, such as adjusting shims, rocker arms, roller rockers, cams, piston rings, piston pins and apex seals, and bearing parts such as slide bearings and roller bearings.

Silicon nitride ceramics are known to have excellent mechanical properties in hardness, strength, heat resistance, etc. and possess a big potential as materials for mechanical structures. But silicon nitride ceramics are typically hard but brittle materials. Therefore, it is required to select an appropriate machining method for providing a geometric shape as required by the end products and also to improve the strength and durability of the finished products.

At the present time, the best-used method for machining silicon nitride ceramics is grinding with a diamond grinding wheel. But this method tends to leave damage such as cracks on the machined surface, which will lower the strength and reliability. This has been a major obstacle to application of these materials.

For example, as Ito points out (in a book titled "Recent Fine Ceramics Techniques", page 219, published by Kogyo Chosakai in 1983), there is a correlation between the surface roughness of silicon nitride ceramics machined by grinding and the bending strength and it is required to keep the surface roughness below 1 micrometer to ensure reliability in strength. Also, as has been pointed out by Yoshikawa (FC report, vol 8, No. 5, page 148, 1990), the depth of cracks formed when grinding depends on the grain size of the diamond grinding wheel used. Such cracks formed in silicon nitride ceramics materials may be as deep as 20–40 micrometers (or microns). Cracks of this order can make the end product totally useless.

As shown in Japanese Patent Unexamined Publication 63-156070, silicon nitride ceramics having a bending resistance of 100 kg/mm$^2$ or more under JIS R1601 are especially difficult to grind with an ordinary diamond grinding wheel. Also, the possibility of causing surface damage increases.

It is known to finish a surface damaged by normal grinding with a diamond grinding wheel by polishing or lapping with abrasive grains to remove any damaged surface and thus to increase the strength of the product. But such a method is extremely problematic from an economical viewpoint.

But the grinding method using a diamond grinding wheel is superior in flexibility of machining facility and machining cost. Thus, it is essential to establish a method of grinding silicon nitride ceramics with a diamond grinding wheel without the fear of surface damage. One way to remove the influence of surface damage was disclosed by Kishi et al ("Yogyo Kyokai Shi", vol. 94, first issue, page 189, 1986), in which after grinding β-Sialon, a silicon nitride ceramic, it is subjected to heat treatment at 1200° C. in the atmosphere to form an oxide layer on its surface to fill the damaged parts with the layer and improve the strength. It is known that this method can increase the bending strength, its reliability and the Weibull modulus of the material ("Yogyo Kyokai Shi", vol. 95, sixth issue, page 630, 1987).

But in this method, since the heat treatment is carried out after finishing the material into a final shape, the dimensional accuracy tends to decrease. Also, as pointed out by Kishi et al ("Yogyo Kyokai Shi", vol. 95, sixth issue, page 635, 1987), this method has a problem in that it is difficult to keep down variations, depending upon the size of the damage on the material before heat treatment. Thus, it is difficult to use this method in the actual production.

In order to solve these problems, is necessary to develop a machining method which provides a sufficiently smooth surface roughness (e.g. Rmax<0.1 micrometer) and by which the surface damage such as cracks can be repaired after grinding or even during grinding.

One method of this type is disclosed by Ichida et al ("Yogyo Kyokai Shi", vol. 94, first issue, page 204, 1986), in which a mirror finish is obtainable by grinding a β-Sialon sintered body with a fine-grained diamond grinding wheel while forming flow type chips. Also, Ito shows that it is possible to form a mirror finish by grinding silicon nitride ceramics with an ordinary alumina grinding wheel ("Latest Fine Ceramics Techniques", published by Kogyo Chosakai, page 219, 1983).

The finished surfaces obtained by these techniques show a maximum height-roughness Rmax of 0.03 micrometer. Considering the fact that the crystal grain diameters of silicon nitride and β-Sialon are both several micrometers, it appears the statements of Ichida and Ito, that is, "removal of material by forming flow type chips chiefly by plastic deformation" and "removal of material mainly by abrasion and microscopic crushing" cannot fully explain the above phenomenon. Further, in the former literature, the work is a pressureless sintered body. It is somewhat inferior in mechanical properties compared with silicon nitride ceramics, which are expected to be widely used for precision machining parts in the future. In this respect, the mechanism of material removal is dependent upon the properties of the material.

It is an object of the present invention to provide an industrially feasible grinding method which can provide a sufficiently smooth finished surface, i.e. a surface having a maximum height-surface roughness Rmax of 0.1 micrometer or less and a ten-point mean roughness Rz of 0.05 micrometer and which can repair any surface damage during grinding.

SUMMARY OF THE INVENTION

In order to solve the above problems, according to the present invention, there is provided a method of grinding silicon nitride ceramics in which the mechanical and thermal effects of the contact pressure and grinding heat produced between the workpiece and the hard abrasive grains (such as diamond abrasive grains) during grinding are combined to form a surface layer 2 on the surface of the workpiece (or substrate 1) and thus to provide a sufficiently smooth surface on the workpiece in an economical way.

According to the present invention, the most important factor in combining the above-mentioned mechanical and thermal effects is the speed (or feed rate) of a grinding wheel into the workpiece. Specifically, we found that as for a mechanical effect, the feed rate of the grinding wheel in a vertical direction to the workpiece should be within the range of 0.005 to 0.1 micrometers (or microns) per rotation of the working surface of the grinding wheel and also should be linear or stepwise and that as for a thermal effect the machining (or cutting) speed of the grinding wheel in a horizontal (or rotational) direction should be 25 to 75 meter/sec. inclusive.

If the feed rate of the grinding wheel is less than 0.005 micrometers (per rotation), the mechanical effect will be low and the machining time will be unduly long. If the feed rate is more than 0.1 micrometers (per rotation), the mechanical effect will be so strong that removal of material as well as brittle crushing will occur on the surface of the work. If the machining speed in a horizontal direction is less than 25 meter/sec., the thermal effect will be insufficient namely the grinding heat will not be sufficiently produced. If greater than 75 meter/sec., the mechanical cost of the grinder increases and disturbances due to high-speed operation will occur.

Considering the fact that a surface roughness comparable to a surface roughness obtained by ordinary mirror surface grinding is easily obtainable and that the size of the silicon nitride crystal grains, which account for most parts of the silicon nitride ceramics, is on the order of 1–10 micrometers, it is not conceivable that such smooth surface can be achieved merely by the formation of flow type chips due to plastic deformation at the grain boundary. Taking these facts into consideration, we analyzed the surface finished by grinding in detail. As a result, we found that in order to improve strength reliability and surface smoothness and also from an economical viewpoint, the surface layer 2 which is deposited on the surface of the silicon nitride ceramics (substrate) during grinding should be formed of one or more amorphous or crystalline substances containing silicon as a main ingredient so that the atomic ratio of oxygen and nitrogen O/N will change continuously or intermittently within the range of 0.25 to 1.0. Part of the surface layer serves to fill up any openings such as cracks formed in the surface before machining. This assures smoothness of the machined surface. The products obtained by use of the machining method of the present invention show an increase in the absolute value of the bending strength and a decrease in variation of the absolute value.

The end product according to the present invention has to meet the following requirements.

1. The maximum height-roughness Rmax of the surface finished by grinding should be 0.1 micrometer or less and the ten-point mean roughness Rz should be 0.05 micrometer or less. If the surface roughness is more than 0.1 micrometer, this means that the surface smoothness is insufficient and that the cracks formed before machining are not filled up sufficiently.
2. The thickness of the surface layer which is deposited during grinding should have a thickness of 20 micrometers or less. If more than 20 micrometers, the surface layer would show thermal and mechanical properties different from those of the matrix. This may produce tensile stress between the matrix and the surface layer, resulting in the deterioration of the surface layer.

On the other hand, in order to form an end product which satisfies the above requirements the grinding method according to the present invention has to meet the following requirements.

1. The diamond grinding wheel used should have an average abrasive grain size of 5 to 50 micrometers and the degree of concentration should be not less than 75 and not more than 150. Also, its binder should preferably be an organic material If the average abrasive grain size is larger than 50 micrometers, the contact area with the workpiece at the grinding point would be so large that the grinding heat generated at the grinding point would not be be sufficient to form the surface layer. If smaller than 5 micrometers, the grinding wheel may become glazed, thus lowering the machining efficiency. On the other hand, if the degree of concentration is less than 75, the number of abrasive grains that actually act to cause grinding would decrease, so that the depth of cut by the abrasive grains would increase and cracks due to plastic strain might form at the grinding point. If greater than 150, the grinding wheel would become glazed due to an insufficient number of chip pockets in the grinding wheel. This lowers the machining efficiency. These observations are contradictory to the conventional concept that a favorable mirror finish is obtainable simply by use of a grinding wheel with fine abrasive grains.
2. The vibration component of the grinding systems should be 0.5 micrometers or less as expressed in terms of the displacement of the grinding wheel by vibration. If the displacement by vibration is more than 0.5 micrometers, contact pressure between the abrasive grains and the workpiece will fluctuate due to the vibration, so that it will become difficult to maintain a contact pressure sufficient to deposit the surface layer.

As to how the surface layer is deposited, its detailed mechanisms are not clearly known. But with the softening of the grain boundary layer 2 due to thermal and mechanical loads that act on the workpiece during grinding, as Ikuhara et al observes in connection with a microstructural analysis during high-temperature creeping of a silicon nitride ceramics material (1990 Summer Materials prepared by Japan Ceramic Society, page 461), it is considered that the deformation of the crystal grains or the dispersion of substances are due to the concentration of defects such as dislocations which occur in the silicon nitride crystal grains and the synthesis of a surface layer by the solid solution of oxygen due to mechano-chemical action.

If such silicon nitride ceramic products having an improved surface roughness are used as friction parts such as adjusting shims, piston pins and piston rings, which are brought into frictional contact with metal parts at high speed, the energy loss due to friction can be reduced markedly compared with conventional metal parts. Heretofore, when such ceramics parts and metal parts are brought into frictional contact with each other, the ceramics parts had a strong tendency to abrade or damage the mating metal parts. In contrast, the ceramics product according to the present invention will never damage the mating parts. Such lubricating effects are presumably brought about by the surface deposit layer containing an oxygen element.

For highly efficient and highly accurate mirror surface grinding, among the above-described various machining conditions, namely various machining speeds of the grinding wheel with respect to the workpiece, the feed rate of the grinding wheel into the workpiece (in the vertical direction F in FIG. 4) has to be 0.005 to 0.1 micrometers per rotation of the grinding wheel in a linear or stepwise manner and the cutting speed of the grinding wheel in a horizontal (rotational) direction has to be 25 to 75 m/sec. and further the component of vibration of the grinding assembly has to be 0.5 micrometer or less in terms of displacement by vibration of the grinding wheel According to the present invention, a silicon nitride ceramics product is obtainable which is satisfactory in strength, reliability and especially in its frictional properties with metal parts and also from an economical viewpoint.

Other features and advantages of the present invention will become apparent from the following description taken with reference to the accompanying drawings in which:

DETAILED DESCRIPTION OF THE PREFERRED EMBODIMENT

EXAMPLE 1

Figure 1:
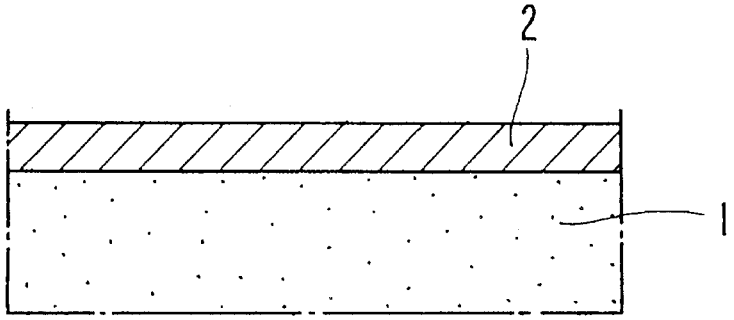
FIG. 1 is a schematic view of the silicon nitride ceramics product obtained by the grinding method according to the present invention.
Figure 2:
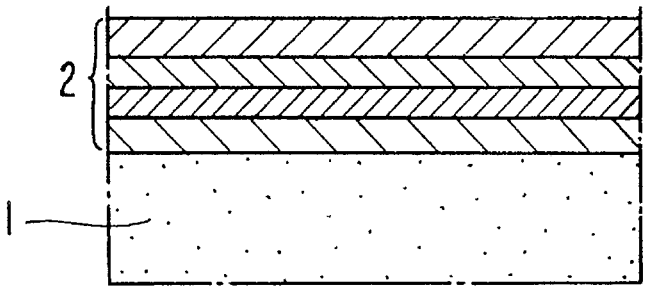
FIG. 2 is an enlarged view of the surface layer in which the atomic ratio O/N changes intermittently from 0.9 at the top to 0.2 at the bottom.
Figure 3:
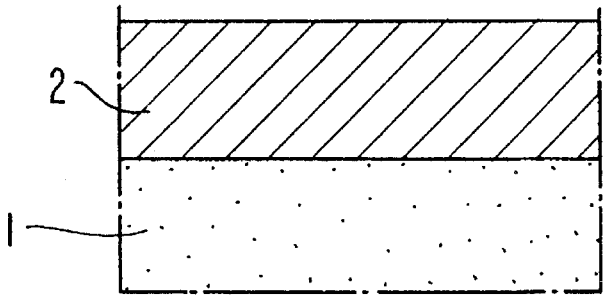
FIG. 3 is an enlarged view of the surface layer in which the atomic ratio O/N changes continuously.

As material-powder comprising 93 percent by weight of $\alpha$-$Si_3N_4$ powder, SN-E10 made by Ube Kosan, which was prepared by imide decomposition, 5% by weight of $Y_2O_3$ powder made by Shinetsu Chemical and 2% by weight of $Al_2O_3$ powder made by Sumitomo Chemical was wet-blended in ethyl alcohol with a ball mill made of nylon for 72 hours and then dried. The powder mixture thus obtained was press-molded into the shape of a 50×10×10 $mm^2$ rectangular parallelopipedon. The molded article was sintered in $N_2$ gas kept at 3 atm. at 1700° C. for four hours. Then it was subjected to secondary sintering in $N_2$ gas kept at 80 atm. at 1750° C. for one hour. The four longitudinal sides of the sintered mass thus obtained were ground with a #325 resin-bonded diamond grinding wheel (degree of concentration: 75) under the conditions of: speed of the grinding wheel: 1600 meter/min.; depth of cut: 10 micrometers (or microns); water-soluble grinding fluid used; and the number of times of the spark-out grinding: 5, until the remainder of the machining allowance reached 5 micrometers. The maximum height-roughness Rmax of the surface thus obtained was 1.8 micrometers. This surface was further machined under the conditions shown in the following tables. In this machining, a type 6A1 grinding wheel 10 was used, more specifically its end face was used (machining with a so-called cup type grinding wheel). The grinding wheel used was #1000 diamond abrasive grains. The degree of concentration was 100. The cutting feed rate of the grinding wheel into the workpiece was set at 0.2 micrometers per rotation of the type 6A1 grinding wheel.

Figure 4:
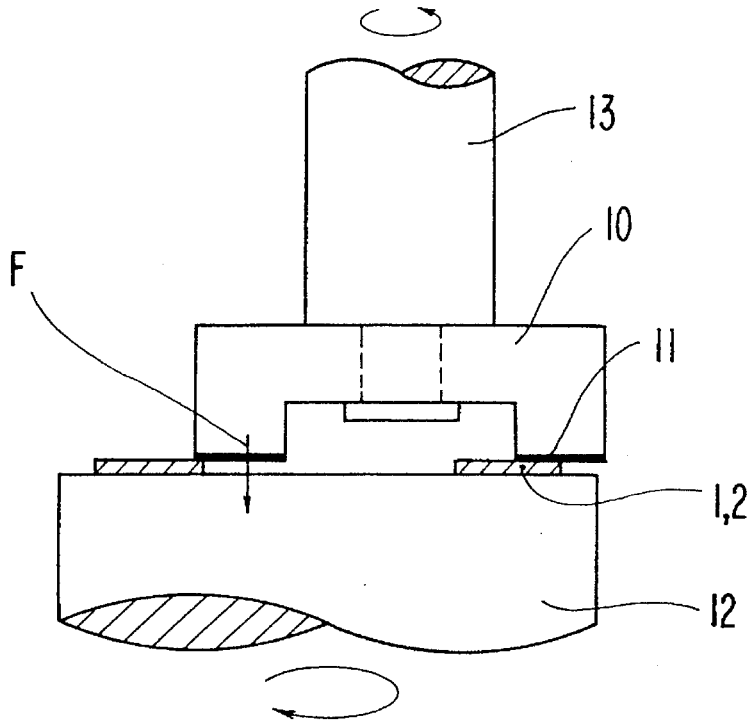
FIG. 4 is a partially sectional front view of the apparatus for grinding silicon nitride ceramics according to the present invention.
Figure 5:
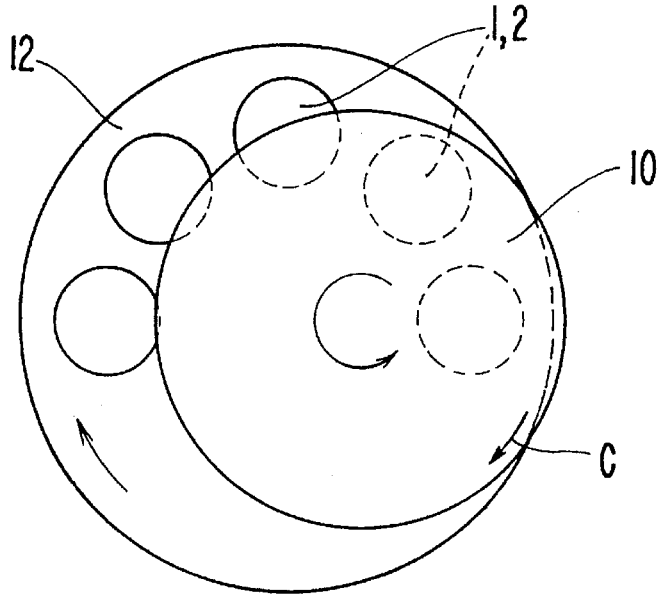
FIG. 5 is a plan view of the apparatus shown in FIG. 4.

FIG. 4 and 5 schematically show the apparatus for grinding silicon nitride ceramics according to the present invention.

Relative displacement between the grinding wheel 10 and the workpiece due to vibration during mirror grinding was measured in terms of displacement of the rotating grinding wheel at its outer periphery by use of an optical microscopic displacement meter. The relative displacement measured was 0.1 micrometers (or microns). The surface roughness measurements of the products thus obtained are shown in Table 1. The workpiece 1, 2 was supported on a work table 12, and the grinding wheel 10 was mounted to a wheel spindle 13.

Also, we measured the ratio of nitrogen and Oxygen elements contained in the surface layer 2 of each product thus obtained with an ESCA. The ratio (atomic ratio O/N) was 0.50–0.75. Similar measurements were made while removing the surface layers by ion milling. The results revealed that in the layer up to the depth of 5 micrometers from the surface, the O/N ratio changes continuously from 0.75 to 0.35.

On the other hand, as comparative examples, a workpiece was machined with the #200 resin-bonded diamond grinding wheel 10. Then its machining allowance was lapped with #2000 and #4000 free diamond abrasive grains (average grain diameter: 1–5 micrometers) for 20 hours, The maximum height-roughness after machining was Rmax=0.08 micrometers and the ten-point mean roughness was Rz=0.02 micrometers. Its surface was analyzed in a manner similar to the above. Oxygen elements were not observed.

30 flexural bending test pieces obtained by the machining method according to the present invention and the methods shown as comparative examples were subjected to a three-point bending strength test. The results are shown in Table 2 in comparison with No. 1 in the EXAMPLE.

EXAMPLE 2

Sintered materials similar to EXAMPLE 1 and silicon nitride ceramics finished under the above conditions were ground to provide mirror surfaces. The results are shown in Table 3. The cutting feed rate of the grinding wheel into the workpiece was 0.025 micrometers per rotation of the type 6A1 grinding wheel and the horizontal machining (or cutting) speed (in the direction C) was 40 m/sec.

TABLE 1

| | Speeds of Grinding Wheel Relative to Workpiece | | Surface |
|---|---|---|---|
| No | in vertical feed rate** | in rotational cutting speed | roughness Rmax |
| ① | 0.025 μm | 55 m/sec | 0.03 μm |
| ※ ② | 0.025 μm | 10 m/sec | 0.2 μm |
| ③ | 0.025 μm | 30 m/sec | 0.04 μm |
| ※ ④ | 0.2 μm | 45 m/sec | 1.20 μm |
| ⑤ | 0.010 μm | 45 m/sec | 0.05 μm |
| ※ ⑥ | 0.0025 μm | 30 m/sec | 1.50 μm |

※ shows the results for comparative examples
**The cutting feed rate of the grinding wheel in the vertical direction into the workpiece is expressed in infeed per one rotation of the working surface of the grinding wheel.

TABLE 2

| | 3-point bending strength ($kg/mm^2$) | Weibull modulus |
|---|---|---|
| Present invention | 136.5 | 23.2 |
| Comparative Example | 109.8 | 14.9 |

TABLE 3

| | Particle size of grinding wheel | Degree of | Displacement by vibration | Surface roughness of machined surface | | Results of analysis of machined surface |
|---|---|---|---|---|---|---|
| No | (medium) | Concentration | of grinding wheel | Rmax | Rz | O/N (atomic ratio) |
| ● 1 | #1000 (15~30 μm) | 125 | 2 μm | 2 μm | 0.3 | 0.12 |
| 2 | #1000 (15~30 μm) | " | 0.5 | 0.07 | 0.02 | 0.70 |
| 3 | #1000 (15~30 μm) | " | 0.05 | 0.03 | 0.006 | 0.75 |
| ● 4 | #4000 (3~5 μm) | 100 | 0.5 | 0.12 | 0.05 | 0.10 |
| ● 5 | #1000 (15~30 μm) | 50 | " | 0.14 | 0.06 | 0.12 |
| ● 6 | #1000 (15~30 μm) | 175 | " | 0.11 | 0.04 | 0.15 |
| 7 | #800 (20~40 μm) | 100 | 0.05 | 0.04 | 0.007 | 0.80 |
| 8 | #800 (20~40 μm) | 125 | " | 0.05 | 0.009 | 0.78 |

● shows the results for comparative examples

※ For analysis of machined surface, measurements were made after removing the oxide layer on the surface by cleaning with a solvent and ion sputtering to eliminate any effect of the oxide layer formed on the surface with lapse of time.

What is claimed is:

1. A silicon nitride ceramic product obtained by a grinding method comprising the steps of:

positioning a grinding wheel, having a rotational axis about which it is rotatable, relative to a silicon nitride ceramic workpiece;

rotating said grinding wheel about its rotational axis at a peripheral cutting speed of not less than 25 meters/second and not more than 75 meters/second;

moving one of the workpiece and said grinding wheel toward the other of the workpiece and said grinding wheel so as to cause said grinding wheel to be fed into the workpiece in a direction parallel to said rotational axis at a feed rate of not less than 0.005 microns per rotation of said grinding wheel and not more than 0.1 microns per rotation of said grinding wheel;

varying said feed rate; and wherein the workpiece is ground such that said work product has a surface finish having a maximum height-roughness surface roughness Rmax of 0.1 microns or less and a ten-point mean roughness Rz of 0.05 microns or less;

wherein said work product comprises a surface layer formed during grinding;

wherein said surface layer includes substances containing silicon as a main ingredient and containing nitrogen and oxygen; and wherein an atomic ratio of the oxygen to nitrogen changes continuously through said surface layer within a range of not less than 0.25 and not more than 1.0.

2. A silicon nitride ceramic product obtained by a grinding method, as recited in claim 1, wherein in said step of varying said feed rate, said feed rate is linearly varied.

3. A silicon nitride ceramic product obtained by a grinding method, as recited in claim 2, wherein said substances comprise amorphous substances.

4. A silicon nitride ceramic product obtained by a grinding method, as recited in claim 3, wherein said surface layer has a thickness of 20 microns or less.

5. A silicon nitride ceramic product obtained by a grinding method, as recited in claim 2, wherein said substances comprise crystalline substances.

6. A silicon nitride ceramic product obtained by a grinding method, as recited in claim 5, wherein said surface layer has a thickness of 20 microns or less.

7. A silicon nitride ceramic product obtained by a grinding method, as recited in claim 1, wherein in said step of varying said feed rate, said feed rate is stepwise varied.

8. A silicon nitride ceramic product obtained by a grinding method, as recited in claim 7, wherein said substances comprise amorphous substances.

9. A silicon nitride ceramic product obtained by a grinding method, as recited in claim 4, wherein said surface layer has a thickness of 20 microns or less.

10. A silicon nitride ceramic product obtained by a grinding method, as recited in claim 7, wherein said substances comprise crystalline substances.

11. A silicon nitride ceramic product obtained by a grinding method, as recited in claim 10, wherein said surface layer has a thickness of 20 microns or less.

12. A silicon nitride ceramic product obtained by a grinding method, as recited in claim 1, wherein said surface layer has a thickness of 20 microns or less.

13. A silicon nitride ceramic product obtained by a grinding method comprising the steps of:

positioning a grinding wheel, having a rotational axis about which it is rotatable, relative to a silicon nitride ceramic workpiece;

rotating said grinding wheel about its rotational axis at a peripheral cutting speed of not less than 25 meters/second and not more than 75 meters/second;

moving one of the workpiece and said grinding wheel toward the other of the workpiece and said grinding wheel so as to cause said grinding wheel to be fed into the workpiece in a direction parallel to said rotational axis at a feed rate of not less than 0.005 microns per rotation of said grinding wheel and not more than 0.1 microns per rotation of said grinding wheel;

varying said feed rate; and wherein the workpiece is ground such that said work product has a surface finish having a maximum height-roughness surface roughness Rmax of 0.1 microns or less and a ten-point mean roughness Rz of 0.05 microns or less;

wherein said work product comprises a surface layer formed during grinding;

wherein said surface layer includes substances containing silicon as a main ingredient and containing nitrogen and oxygen; and wherein an atomic ratio of the oxygen to nitrogen changes intermittently through said surface layer within a range of not less than 0.25 and not more than 1.0.

14. A silicon nitride ceramic product obtained by a grinding method, as recited in claim 13, wherein in said step of varying-said feed rate, said feed rate is linearly varied.

15. A silicon nitride ceramic product obtained by a grinding method, as recited in claim 14, wherein said substances comprise amorphous substances.

16. A silicon nitride ceramic product obtained by a grinding method, as recited in claim 15, wherein said surface layer has a thickness of 20 microns or less.

17. A silicon nitride ceramic product obtained by a grinding method, as recited in claim 14, wherein said substances comprise crystalline substances.

18. A silicon nitride ceramic product obtained by a grinding method, as recited in claim 17, wherein said surface layer has a thickness of 20 microns or less.

19. A silicon nitride ceramic product obtained by a grinding method, as recited in claim 13, wherein in said step of varying said feed rate, said feed rate is stepwise varied.

20. A silicon nitride ceramic product obtained by a grinding method, as recited in claim 19, wherein said substances comprise amorphous substances.

21. A silicon nitride ceramic product obtained by a grinding method, as recited in claim 20, wherein said surface layer has a thickness of 20 microns or less.

22. A silicon nitride ceramic product obtained by a grinding method, as recited in claim 19, wherein said substances comprise crystalline substances.

23. A silicon nitride ceramic product obtained by a grinding method, as recited in claim 22, wherein said surface layer has a thickness of 20 microns or less.

24. A silicon nitride ceramic product obtained by a grinding method, as recited in claim 13, wherein said surface layer has a thickness of 20 microns or less.

* * * * *